US005823537A

United States Patent [19]

Blanton

[11] Patent Number: 5,823,537

[45] Date of Patent: Oct. 20, 1998

[54] MARTIAL ARTS GAME METHOD

[76] Inventor: Stephen F. Blanton, P.O. Box 22, Tangerine, Fla. 32777

[21] Appl. No.: 905,651

[22] Filed: Aug. 4, 1997

[51] Int. Cl.[6] ..... A63B 67/00

[52] U.S. Cl. ..... 273/440.1; 473/415

[58] Field of Search ..... 273/440.1; 473/415, 473/465, 470, 471, 476, 477, 569, 590, 592, 596, 124, 128, 207, 226, 228; 482/14, 109

[56] References Cited

U.S. PATENT DOCUMENTS 648,512 5/1900 Manley ..... 473/477
3,792,864 2/1974 Kelly ..... 473/569
3,933,354 1/1976 Goldfarb et al. .
4,627,620 12/1986 Yang .
4,955,602 9/1990 Rastelli .
4,974,833 12/1990 Hartman et al. .
5,221,243 6/1993 Walker ..... 482/83

*Primary Examiner*—William H. Grieb
*Attorney, Agent, or Firm*—William M. Hobby, III

[57] ABSTRACT

A martial arts game method includes the steps of selecting a predetermined playing field marked off in a predetermined manner and having a goal pole at each end thereof. Each goal pole has a removably attached kick scoring member attached in a predetermined position. A baton is selected along with a plurality of martial arts players to form two teams. One team is given possession of the selected baton for the players to move the baton down the selected field to the goal pole to kick the kick scoring member on the goal pole to one side over the defense of the other martial arts team using martial arts techniques to defend the goal pole at one end of the selected playing field.

9 Claims, 2 Drawing Sheets

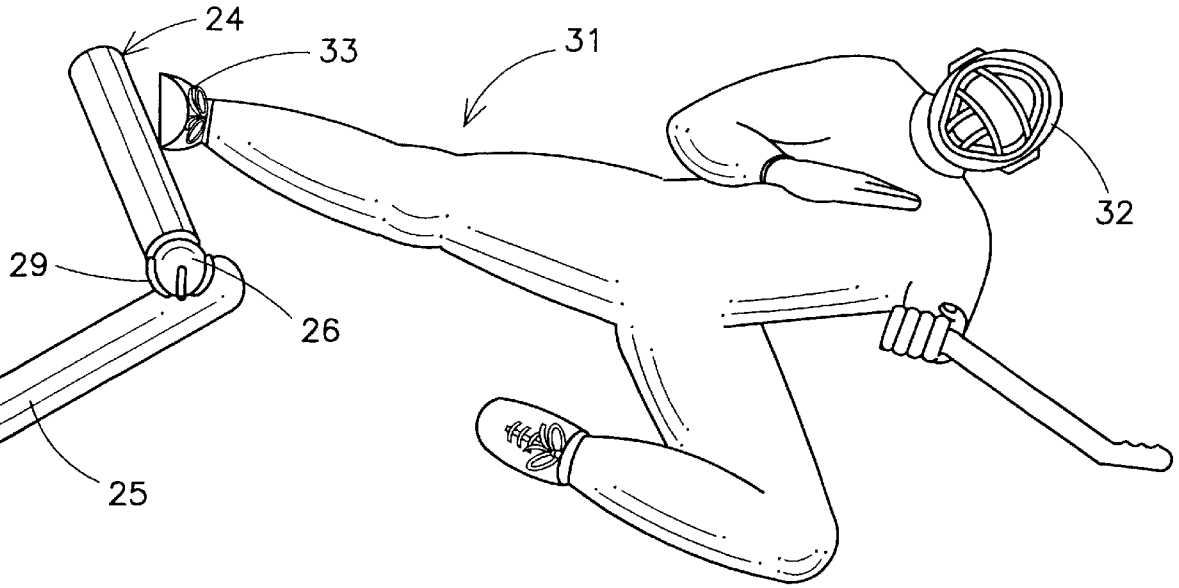
FIG. 2
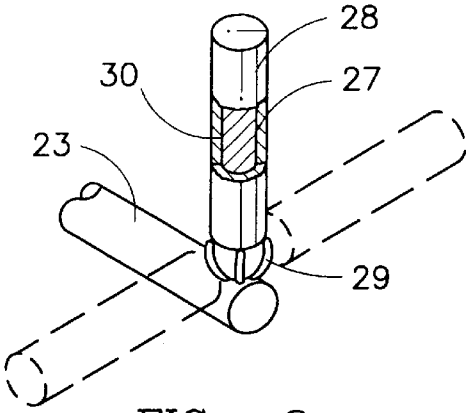
FIG. 3
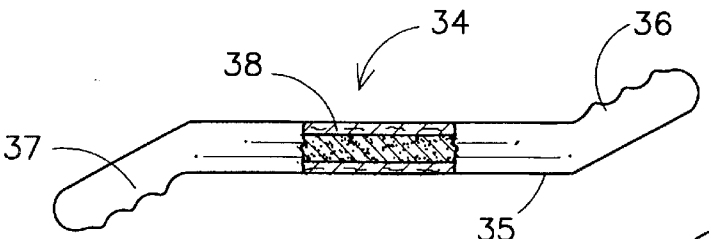
FIG. 4
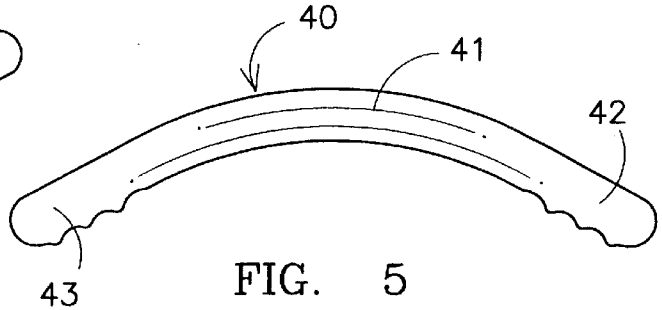
FIG. 5
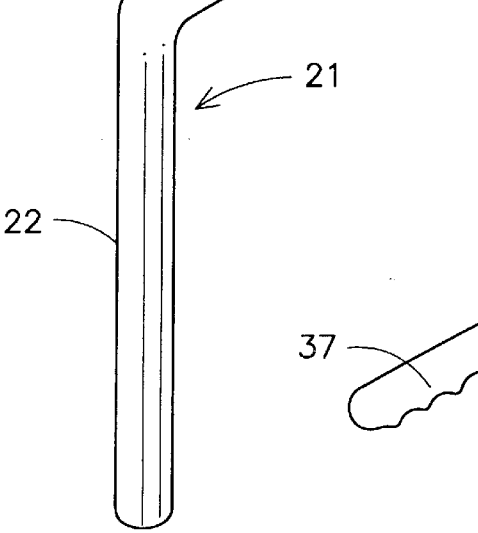

MARTIAL ARTS GAME METHOD

BACKGROUND OF THE INVENTION

The present invention relates to a method for playing a game and particularly to a new game utilizing martial arts techniques.

Persons in the martial arts, such as Karate, Kung Fu, Tae Kwon Do, and the like, have been for many years trained by hitting or kicking a striking pad, bag, boards or other members. Martial art students try to develop split second reflexes of a physical and mental nature and constantly train themselves to be able to perceive, analyze, and react to a given situation rapidly. Various techniques of developing such reflexes have been widely used. A martial art student can practice with a partner or teacher or can drill to instructions from a teacher. The martial arts have also attracted spectator interest in the United States and other countries in response to a growing awareness of oriental culture. However, training in martial arts has commonly been practiced between two individuals or between a student and an individual or teacher in a training facility. There have also been a wide variety of training devices, such as breaking board devices and other devices, for use in practicing the martial arts. One of the most common types of training devices has been striking surfaces of different types. Striking surfaces have included posts buried in the ground, makawari boards, which are boards mounted in a holding fixture and having striking areas which are covered with foam, straw, or the like. Punching bags have commonly been used and are generally hung from above or placed on the floor or suspended between the floor and ceiling. Hand-held striking surfaces are used which allow the target to be moved from place-to-place by a training partner. It has also been suggested to provide striking surfaces which include sensors for measuring the force of the strike. Breaking boards include one or more boards held by a training partner which are broke by a sharp blow with the hand or foot.

A prior art martial arts training center can been seen in U.S. Pat. No. 5,221,243 to Walker for an electronically controlled and monitored sports training competition and amusement center adapted for use for the martial arts. Other martial arts training devices can be seen in the Hartman et al. U.S. Pat. No. 4,974,833, for an electronics martial arts training device and in the Rastelli U.S. Pat. No. 4,955,602, for a method and apparatus for training in the martial arts. In the Yang U.S. Pat. No. 4,627,620, an electronic athlete trainer is used for improving the reflex, speed, and accuracy skills of an athlete in which targets are selected electronically in a random sequence. In the Goldfarb et al. U.S. Pat. No. 3,933,354, a reflex testing amusement device for a game is illustrated which features oriental martial arts, such as karate, jujitsu and aikido.

Spectator and team sports are widely played in the U.S. and around the world and includes sports, such as soccer, baseball, basketball and football. Football is one of America's favorite spectator sports and is played on a basic field with each end having an end zone, a field goal post at each end with the field being marked off with lines. A goal post is mounted at each end zone at a predetermined height above the playing field. Two teams are utilized which alternate between offensive and defensive teams. The offensive team moves the football down the marked playing field towards one end zone to try and get the ball in the end zone or over the goal post while the defensive team attempts to prevent the offensive team from scoring. In one prior patent to Foster, No. 4,911,443, a football game system and method are provided for playing conventional football with similar rules to American football within a sports arena and uses specialized goal posts within the arena. A rebounding assembly surrounds a goal post so that an errant kick will result in the ball hitting the rebounding assembly instead of passing between the vertical uprights of the goal post.

The present invention is directed towards a game and method of playing a game utilizing the martial arts. This game differs from martial arts tournaments using full contact kick boxing and fighting in that it is a team sport utilizing a playing field and multiple players on two teams. The sport demonstrates the kicking ability of the players and requires the use of flying side kicks, jumping back kicks, spinning hook kicks, spinning crescent kicks, power front kicks, and angled front kicks between the players and utilizes a baton for the offensive team to move down the field. Thus, the game is a full contact sport which brings the martial arts into more of a spectator sport.

SUMMARY OF THE INVENTION

A martial arts game method includes the steps of selecting a predetermined playing field marked off in a predetermined manner and having a goal pole at each end thereof. Each goal pole has a removably attached kick scoring member attached in a predetermined position. A baton is selected along with a plurality of martial arts players to form two teams. One team is given possession of the selected baton for the players to move the baton down the selected field to the goal pole to kick the kick scoring member to one side over the defense of the other martial arts team using martial arts techniques to defend the goal pole at one end of the selected playing field.

BRIEF DESCRIPTION OF THE DRAWINGS

Other objects, features, and advantages of the present invention will be apparent from the written description and the drawings in which:

FIG. 2 illustrates the playing field goal pole with a player making a score;

FIG. 3 is a perspective view of a portion of the kick scoring member of the goal pole of FIG. 2;

FIG. 4 is a side elevation of a baton for use in the present game; and

FIG. 5 is a side elevation of a second embodiment of a baton for use in the present game.

DESCRIPTION OF THE PREFERRED EMBODIMENTS

Figure 1:
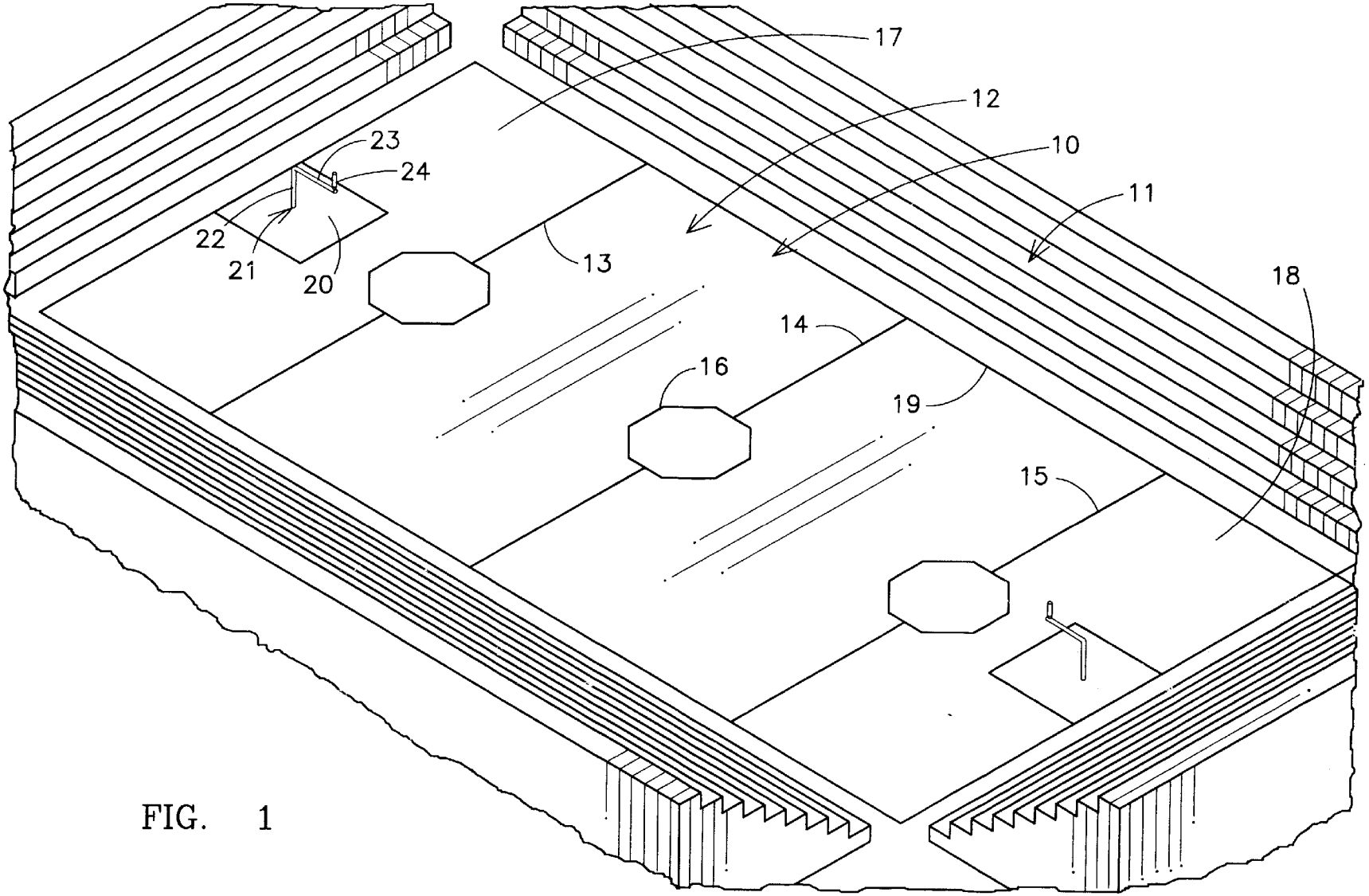
FIG. 1 is a perspective view of a playing field for playing a martial arts game in accordance with the present invention.

Referring to FIG. 1, a playing field 10 for playing a martial arts team game is illustrated having bleachers 11 and having a flat playing field 12 being marked off with lines 13, 14, and 15 defining a playing field inside side lines 19. Each line 13, 14 and 15 has a boxed area 16 formed with in an octagon shape in the middle of each line. The playing field 12 has an end 17 portion at one end and an end portion 18 at the other end. Each end has a goal area 20 having a goal post or pole 21. The goal post 21 has a generally vertical upright portion 22 attached to a generally horizontal extending portion 23 and having a kick scoring member 24 mounted on the end of the horizontal portion 23. The goal post, as more clearly seen in FIGS. 2 and 3, can also have an angled portion 25 replacing the horizontal portion 23 and has the kick scoring portion 24 being a generally cylindrical member having a ball joint 26 held by spring arms 29 to the extending goal post member 25 along one end thereof and has a rod 27 extending therefrom. The kick scoring member 28 may be a generally cylindrical hard rubber member having a hollow interior 30 which is slid over the post 27. The post 27 has the ball joint 26 on one end supported by arms 29 to allow positioning it in different positions, as shown in FIG. 3. A player 31 can have a protective mask 32 and other protective equipment as desired and is shown having the foot 33 kicking the scoring member 24 in an attempt to kick the scoring member to one side off the pole to score a goal.

FIG. 4 illustrates a baton 34 as used in the game which may have a straight cylindrical portion 35 having an angled hand grip 36 on one end and an angled hand grip 37 on the other end of the straight portion 35 and angled in a different direction. A gripping surface 38 may also be provided in the middle of the baton 34.

In FIG. 5, an alternate embodiment of a baton 40 is illustrated in an arcuate shaped portion 41 having a hand grip 42 on one end and a hand grip 43 on the other end thereof.

The game is played on the playing field 12 by two teams of martial arts players. Each team may include seven players with the object of the team in possession of the baton 34 or 40 to advance the baton down the field and score points by whichever player is in possession of the baton by executing a kick sufficient enough to knock down the kick scoring goal member 24, which may be equivalent to breaking two ½" pine boards in a kick. The field 12 (or war zone) can be 150×75 feet or any shape and size desired without departing from the spirit and scope of the invention and is marked off by lines 19 and with a center line 14 and two 15 yard lines 13 and 15. Three octagon demarcation boxes 16 are illustrated along with the goal zone 20 at each end which can be a 15×15' rectangle located on each end of the field but inside the perimeter line 19. The goal pole 21 can be a metal pole wrapped in a covering of a semi-hard core rubber or the like and may be of any dimension, such as a 3" diameter pole of 14" length, but positions the goal member 24 at a height suitable for players to perform various types of kicks to break or knock off the member 24 from the goal pole 21. After each score on the goal pole, the angle of the goal post can be changed, as illustrated in FIG. 3. The game can be played with officials and can be of any duration desired, such as 48 minutes of playing time, divided into four quarters and comprising two halves and can include timeouts and overtimes in the event of a tie. The teams can wear team uniforms, such as skin-tight spandex type suits, covering the body with team designated colors with names and numbers of each player imprinted on each suit and can include appropriate cushioned pads.

The game begins with the sounding of a horn. The team players on each side can start behind the lines 13 or 15 on their end of the field for an opening attack. The opening attack is continued until a defensive player or players score an untallied point on the baton carrier of the offensive team with a kick or legal take-down as judged by an official. An untallied point is a point scored by a defensive player on the baton carrier which ends the play at that point on the field from the field position where the play is stopped in the opening attack. The offensive team will have three attacks or plays in which to advance the baton or try to score a kick on the goal post 24. Each attack ends when the baton becomes dead. The team in possession is allowed a time, such as 35 seconds, to converse strategy before putting the baton back into action from the last point of stopping. If after three attacks the offensive team has not reached the goal zone, the baton is turned over to the opposing team at that point on the field. If the attacking team has penetrated the goal zone on its last attack, it earns an extra attack or play to begin at the defenders 15 yard line in an attempt to score with a kick to the goal post, as shown in FIG. 2. Otherwise, the defending team takes possession and in turn has three plays to try to score on the goal pole on the opposite end of the field. The baton can be handled by any player. On the opening attack, the baton cannot be passed but on subsequent plays, the baton can be passed in any direction between players, in accordance with devised rules for the game. The baton can also be handed off from one player to another at any time so long as it does not have free flight. When the baton is in flight, any player on any team can pursue the baton in flight. An attack or play begins when a player on the offensive team crosses the designated scrimmage line. After a defensive player scores an untallied point on the baton carrier and stops the play, then the offensive team has a time period to initiate the next attack. Scoring occurs when a player carrying the baton kicks down the goal pole scoring member of the opposing team and may be three points for a kickdown with a non-jumping kick or four points for a jumping kick or five points for a jumping spinning kick of 180° or more. Once the baton carrier enters the goal zone, he has a predetermined time, such as 10 seconds, to attempt a scoring kick. A player must use martial arts kicks to fight off an opponent but can initiate a takedown or throw with proper technique only after attempting a kick first. Once a team is within the 15 yard line, no takedown can be used. Illegal techniques can produce a warning or penalty. Striking areas for kicks are the front and sides of the head and body from waist level up. No portion of a backside may be struck but a takedown can be executed from the backside of a player only after engaging that player from the front side. The game includes fouls or penalties, such as any hand, arm, or elbow strike to any area, kneeing, tackling, tripping, low kicks below mid thigh, arm, leg and foot locks, biting, gouging or any unnecessary roughness. The baton cannot be used as a weapon in any manner.

The game is thus played by two teams of martial arts players, one being the offensive team making the attack while the other being the defensive team resisting the attack of the offensive team having the baton with the aim being to score points by driving the baton through the defensive team to the offensive team goal pole and making a kick knockdown or break of the scoring member on the goal pole. However, the present rules outlined herein for playing the game on a playing field as described herein are to be considered illustrative rather than restrictive.

I claim:

1. A martial arts game method comprising the steps of:

selecting a predetermined playing field having two end portions marked off in a predetermined manner and having a goal pole in one end portion, said goal pole having a removably attached kick scoring member attached thereto in a predetermined position;

selecting a playing baton;

selecting a plurality of martial arts players to form two teams; and giving one team possession of the selected baton for the players to move the baton down the selected field to said goal pole to kick the kick scoring member from said goal pole over the defense of the other martial arts team using martial arts techniques to defend said goal pole in one end portion of said selected playing field; whereby martial arts is performed by multiple players in a team sport.

2. A martial arts game method in accordance with claim 1 in which the step of selecting a playing field includes selecting a playing field having a second goal poles mounted in the other end portion of said playing field.

3. A martial arts game method in accordance with claim 2 in which the step of selecting a playing field includes selecting each goal pole with a vertical extending portion and a generally horizontally extending portion and having the kick scoring member attached to the horizontally extending portion.

4. A martial arts game method in accordance with claim 3 including the step of marking the selected playing field with a plurality of line markings.

5. A martial arts game method in accordance with claim 4 in which the step of marking said playing field includes marking with a plurality of box areas.

6. A martial arts game method in accordance with claim 2 in which the step of selecting a baton includes selecting a baton having a generally curved shape and having a hand grip on each end thereof.

7. A martial arts game method in accordance with claim 2 in which the step of selecting a baton includes selecting a baton having a generally elongated cylindrical portion having a hand grip on each end thereof formed at an angle to said elongated cylindrical portion.

8. A martial arts game method in accordance with claim 2 in which the step of selecting a playing field includes selecting a playing field having each goal pole having a kick scoring attaching member mounted thereon for removably attaching a kick scoring member thereto.

9. A martial arts game method in accordance with claim 8 in which the step of selecting a playing field includes selecting each goal pole with a goal pole kick scoring attaching member having a movable rod for placing said kick scoring member thereon.

* * * * *